US008516859B2

(12) United States Patent
Lalonde et al.

(10) Patent No.: US 8,516,859 B2
(45) Date of Patent: Aug. 27, 2013

(54) FOREIGN OBJECT TRAP FOR AN AUTOMATIC WASHER

(75) Inventors: Lauren M. Lalonde, Saugatuck, MI (US); Donald R. Miller, Saint Joseph, MI (US); James C. Miller, Saint Joseph, MI (US); Brenner M. Sharp, Bridgman, MI (US); Jon D. Strait, Saint Joseph, MI (US); Dean L. Tietz, Saint Joseph, MI (US); Nyik Siong Wong, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 861 days.

(21) Appl. No.: 12/643,015

(22) Filed: Dec. 21, 2009

(65) Prior Publication Data

US 2011/0146354 A1 Jun. 23, 2011

(51) Int. Cl.
*D06F 39/10* (2006.01)

(52) U.S. Cl.
USPC ..... 68/18 F

(58) Field of Classification Search
USPC ..... 58/18 F, 23.2, 53, 208; 210/167.01, 210/167.31, 408, 409, 411, 109; 68/18 F, 68/23.3, 53, 208
See application file for complete search history.

(56) References Cited

U.S. PATENT DOCUMENTS

| | | | | |
|---|---|---|---|---|
| 2,470,140 | A | 5/1949 | Castner | |
| 2,900,812 | A | 8/1959 | Smith | |
| 3,216,224 | A | 11/1965 | Poole | |
| 3,246,837 | A | 4/1966 | Douglas | |
| 3,352,130 | A | 11/1967 | Landwier | |
| 3,626,728 | A * | 12/1971 | Traube et al. | 8/18 F |
| 4,357,812 | A | 11/1982 | Braga et al. | |
| 4,357,813 | A | 11/1982 | Sherer et al. | |
| 4,455,844 | A * | 6/1984 | McMillan et al. | 68/18 F |
| 4,485,645 | A | 12/1984 | Mulder et al. | |
| 4,848,105 | A | 7/1989 | O'Connell et al. | |
| 5,018,372 | A | 5/1991 | Altnau, Sr. | |
| 5,989,418 | A * | 11/1999 | Shin | 210/167.01 |
| 6,076,378 | A * | 6/2000 | Shin | 68/18 F |
| 6,820,447 | B2 | 11/2004 | Thies et al. | |
| 7,406,843 | B2 * | 8/2008 | Thies et al. | 68/18 F |
| 2008/0196452 | A1 * | 8/2008 | Bae et al. | 68/18 F |
| 2008/0216518 | A1 * | 9/2008 | Yoo et al. | 68/12.13 |
| 2008/0216522 | A1 * | 9/2008 | Yoo et al. | 68/18 F |

FOREIGN PATENT DOCUMENTS

| | | |
|---|---|---|
| DE | 19756229 A1 | 6/1998 |
| EP | 0626477 B1 | 7/1998 |
| GB | 795853 | 5/1958 |
| GB | 843788 | 8/1960 |

OTHER PUBLICATIONS

German Search Report for DE102010036940, Mar. 13, 2012.

* cited by examiner

*Primary Examiner* — Joseph L Perrin
(74) *Attorney, Agent, or Firm* — Clifton G. Green; McGarry Bair PC

(57) ABSTRACT

An automatic washing machine having a tub defining an interior, a sump in fluid communication with the interior of the tub, a wash basket located within the interior of the tub and defining a laundry treating space, and a foreign object trap located in a portion of the wash basket that defines a foreign object passageway for retaining foreign objects.

14 Claims, 8 Drawing Sheets

FOREIGN OBJECT TRAP FOR AN AUTOMATIC WASHER

BACKGROUND OF THE INVENTION

In automatic clothes washers, the system is designed to process only fabric materials; however, other foreign objects make their way into the wash chamber including buttons, coins, keys, stones, and other small objects. These foreign objects may interfere with the proper operation of the clothes washer, such as interfering with proper liquid flow through a pump or pumps used for recirculation and draining.

Prior clothes washers have addressed the problem by collecting and holding foreign objects, which may cause a number of problems. Collective materials may eventually reduce flow rates by obstructing water flow paths. Some collected materials deteriorate with time and may be redistributed on clothing or cause odor. Other types of materials may add to the accumulation process by causing materials to accumulate that might otherwise be pumped down the drain.

BRIEF DESCRIPTION OF THE INVENTION

The invention relates to a washing machine comprising a tub defining an interior, a sump in fluid communication with the interior of the tub, a wash basket located within the interior and defining a laundry treating space, a clothes mover located within the laundry treating space and overlying at least a portion of the wash basket, and a foreign object trap located in a portion of the wash basket and having a foreign object passageway defining an inlet opening and an outlet opening, with either the inlet opening being an elongated opening having a length and width commensurate with a length-to-width ratio of 7:1 and the outlet opening having an area less than the inlet opening or the passageway is shaped to receive on edge a circular coin having a diameter of at least 24 mm without any portion of the coin contacting any portion of the clothes mover.

DESCRIPTION OF THE PREFERRED EMBODIMENT

Figure 1:
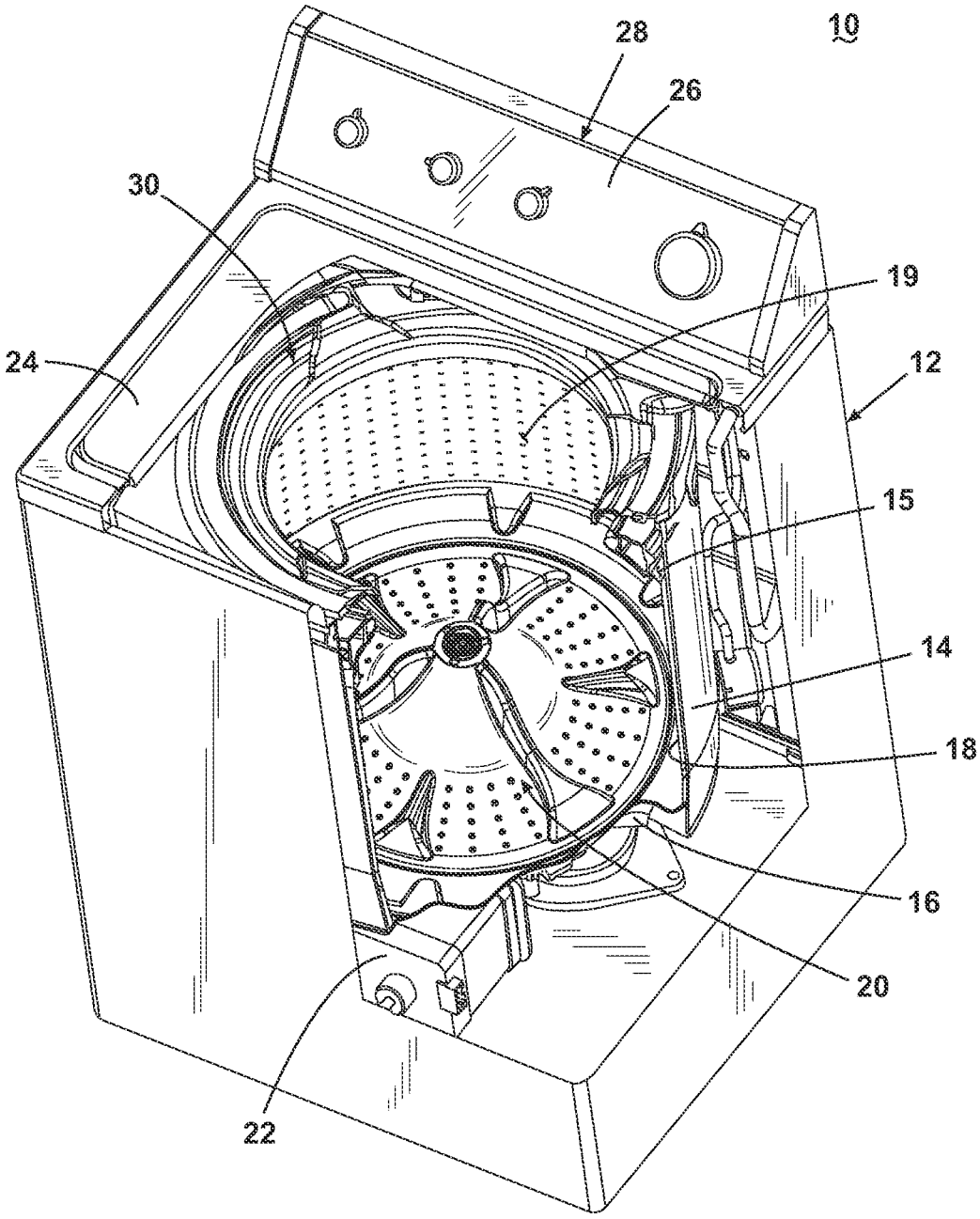
FIG. 1 is a perspective view of an exemplary washing machine according to one embodiment of the invention with a portion cut-away to show interior components of the washing machine.

Referring now to the figures, FIG. 1 is a schematic view of an exemplary washing machine 10 according to one embodiment of the invention. While the washing machine 10 is a top-fill washing machine having a vertical axis of rotation, the invention may have applicability in washing machines with different baskets and a different axis of rotation.

The washing machine 10 may include a cabinet or housing 12 and an imperforate tub 14 that defines an interior 15 of the washing machine 10. A sump 16 may be in fluid communication with the interior 15 of the tub 14. A drum or perforated wash basket 18 may be located within and rotatable relative to the interior 15 of the tub 14 and may define a laundry chamber or laundry treating space 19 for receiving a laundry load. A clothes mover or agitator 20 may be located within the laundry treating space 19 and rotatable relative to and/or with the wash basket 18.

The wash basket 18 and/or the agitator 20 may be driven by an electrical motor 22 operably connected to the wash basket 18 and/or the agitator 20. The agitator 20 may be commonly oscillated or rotated about its axis of rotation during a washing operation in order to produce high water turbulence effective to wash the fabric load contained within the laundry treating space 19. The wash basket 18 may be rotated at high speed to centrifugally extract the wash water from the fabric load and to discharge it from the wash basket 18.

A selectively openable lid 24 may be provided on the top of the housing 12 to provide access into the laundry treating space 19 through the open top of the wash basket 18. A user interface 26, which may be located on a console 28, may include one or more knobs, switches, displays, and the like for communicating with a user, such as to receive input and provide output.

Figure 2:
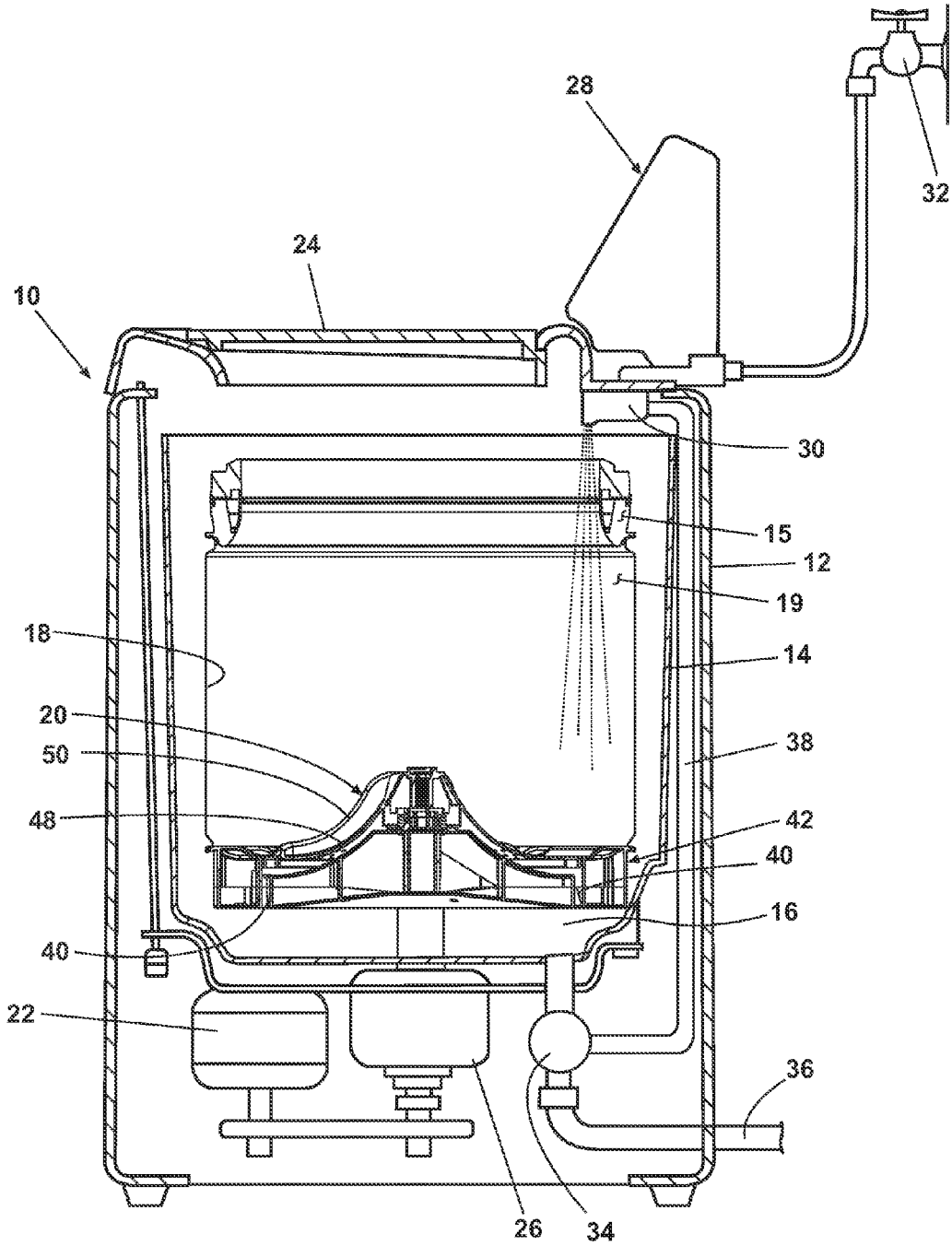
FIG. 2 is a schematic cross-sectional view of the interior components of the washing machine of FIG. 1.

Referring to FIG. 2, a spraying system 30 may be provided to spray liquid, such as water or a combination of water and one or more wash aids, such as detergent, into the open top of the wash basket 18 and onto the top of any fabric or laundry load placed within the laundry treating space 19. The spraying system 30 may be configured to supply water directly from a household water supply and/or from the tub 14 and spray it onto the fabric load. The spraying system 30 may also be configured to recirculate wash water from the tub 14, including the sump 16, and spray it onto the top of the fabric load. As used herein, the terms liquid, water, and wash water are interchangeable and may refer to water or a combination of water and wash aid, including detergents, bleaches, and other wash or rinse aids.

A pump 34 may be housed below the tub 14. The pump 34 may have an inlet fluidly coupled to the sump 16 and an outlet configured to fluidly couple to either or both a household drain 36 or a recirculation conduit 38. In this configuration, the pump 34 may be used to drain or recirculate wash water in the sump 16, which is initially sprayed into the wash basket 18, flows through the wash basket 18, and then into the sump 16. Alternatively, two separate pumps may be used instead of the single pump as previously described.

A foreign object trap 40 may be provided to stop some foreign objects, such as coins, and buttons, from reaching the pump 34 as such items may cause issues in the operation of the pump 34. The foreign object trap 40 may also be designed to allow some foreign objects, which will not interfere with the operation of the pump, such as toothpicks and lint, to pass through to the pump 34 where they may be directed to the drain. The pump 34 may be capable of handling normal quantities of these materials without a problem due to its higher torque motor and clearances within the pump 34.

Figure 3:
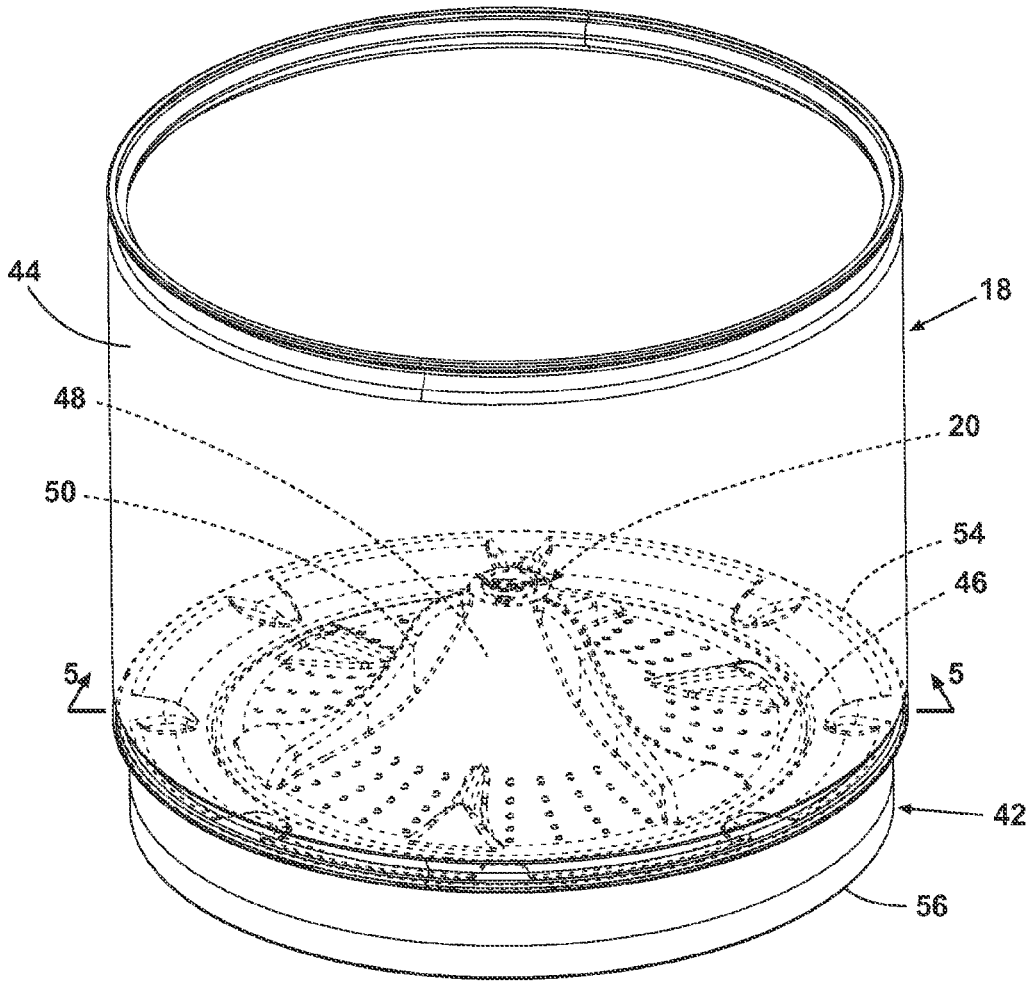
FIG. 3 is a perspective view of the wash basket, impeller, and base of the washing machine of FIG. 1.
Figure 4:
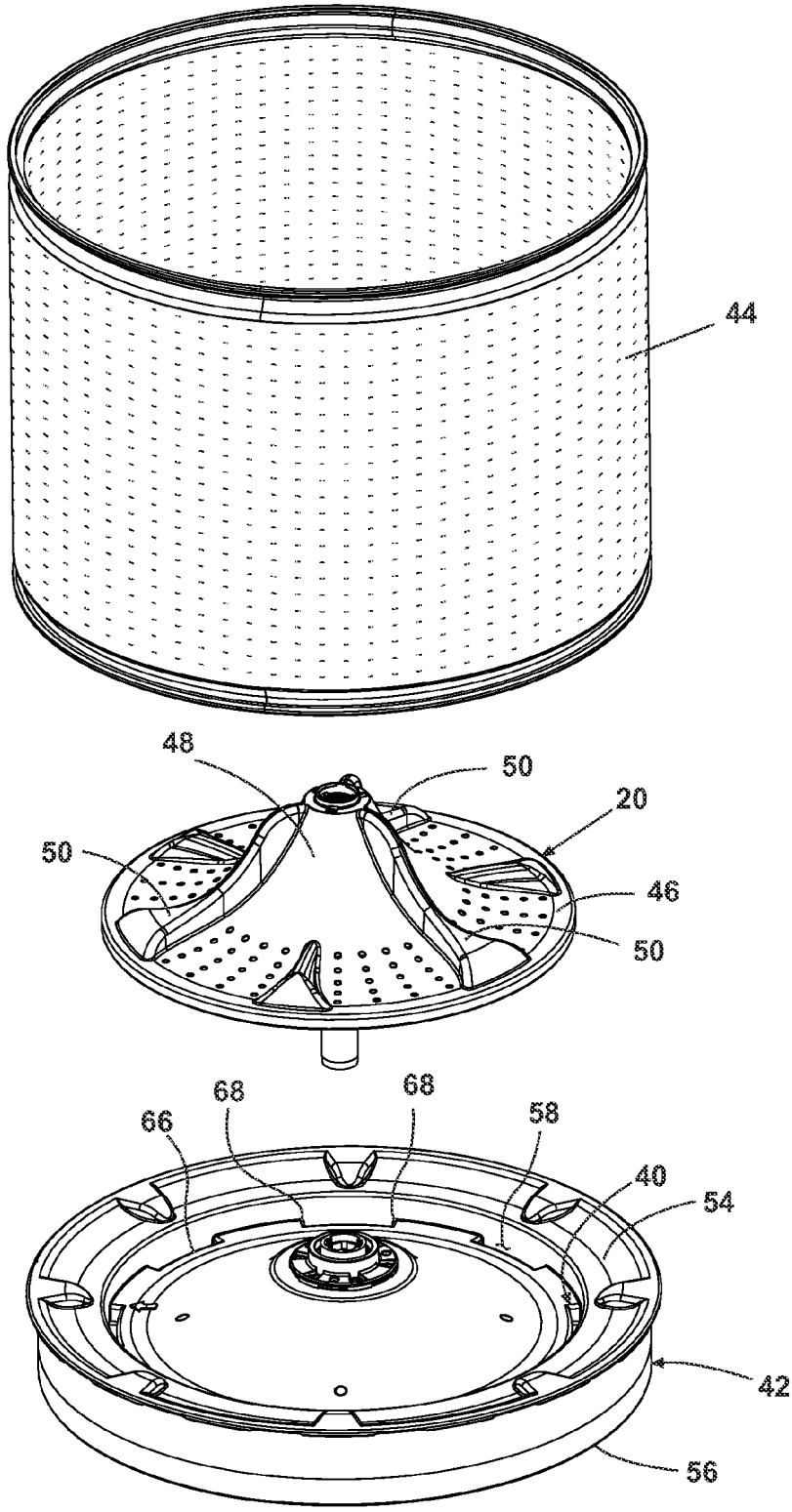
FIG. 4 is an exploded view of the wash basket, impeller, and base shown in FIG. 3.

FIG. 3 illustrates the wash basket 18 and agitator 20 in more detail. The wash basket 18 may include a base 42 and a perforated cylindrical portion 44. The perforations or holes in the basket 18 are not illustrated in FIG. 3 for clarity purposes. The perforated cylindrical portion 44 extends up from the base 42 to define an open-ended drum. The agitator 20 may be more easily seen in FIG. 4. The exemplary agitator 20 may have a lower circular base or peripheral skirt portion 46, a central shaft 48 extending upwardly from the skirt 46, and a plurality of vanes or blades 50 spaced around and extending radially from the central shaft 48. The agitator 20 overlies at least a portion of the base 42 of the wash basket 18 and as illustrated, the agitator 20 may extend over a substantial portion thereof. A variety of other designs for the agitator 20 may also be used without affecting the scope of the invention.

Figure 5:
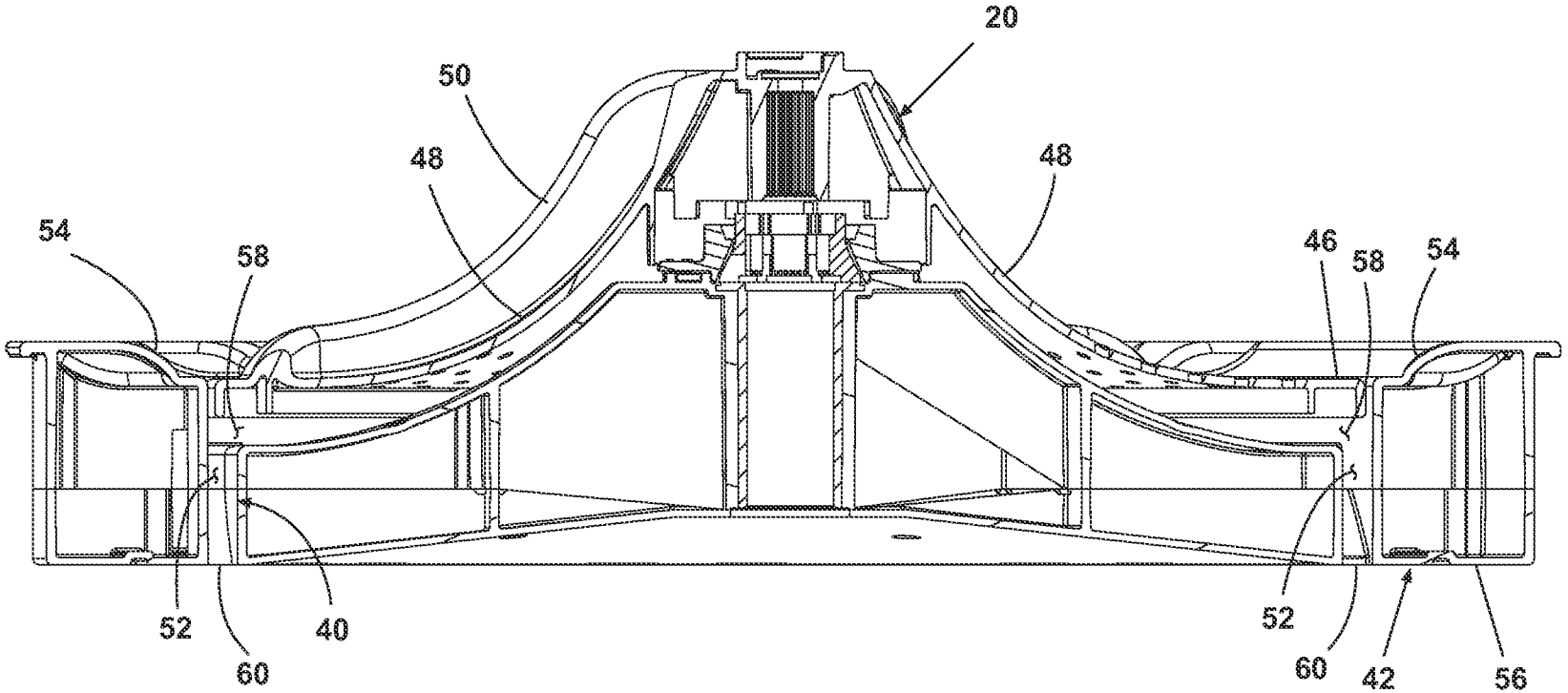
FIG. 5 is a cross-sectional view taken along the line 5-5 of the impeller and base shown in FIG. 3.

As illustrated in FIG. 5, the lower end of the skirt 46 stops just short of the base 42. This allows wash water to flow under the agitator 20 and into the base 42 of the wash basket 18. The foreign object trap 40 may be located in the base 42 such that wash water that flows onto the base 42 passes through a foreign object passageway 52 in the foreign object trap 40 thus segregating and removing such foreign objects from the wash water. The foreign object trap 40 has been illustrated as being located in the base 42 at a location under the agitator. The foreign object passageway 52 has been illustrated as being at a location that is radially inward of the peripheral skirt 46 although its location in other portions of the wash basket 18 is contemplated.

The foreign object passageway 52 extends from the upper side 54 of the base 42 through to the lower side 56 of the base 42. The foreign object trap 40 may include at least one foreign object passageway 52 and preferably includes a plurality of foreign object passageways 52. The plurality of foreign object passageways 52 are spaced apart from each other minimizing the chance that lint, string, etc will bridge between them and contribute to blockage of the foreign object passageways 52.

Figure 6:
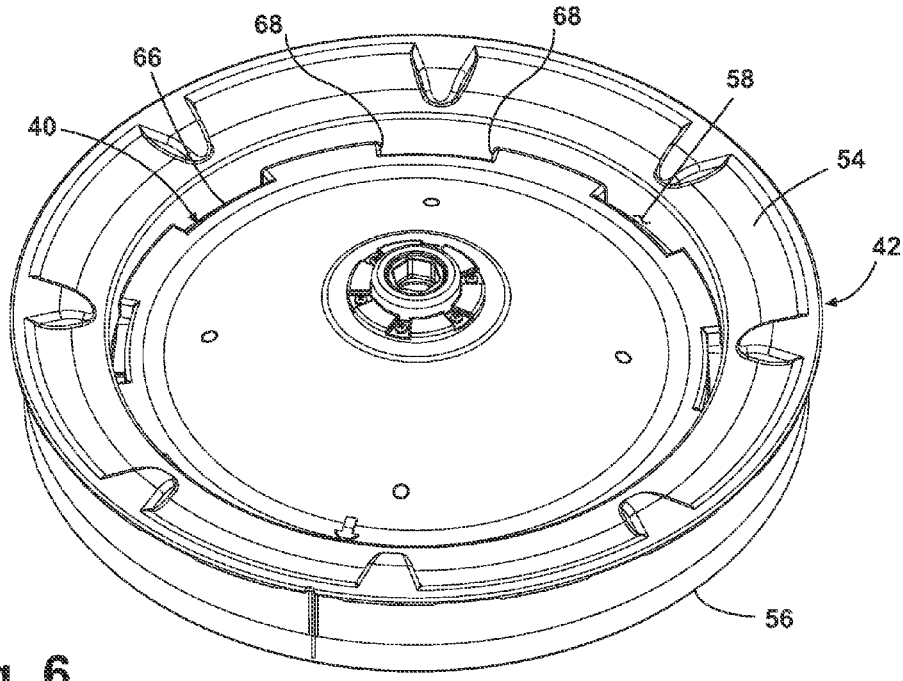
FIG. 6 is a perspective view of the top of the base shown in FIG. 3.
Figure 7:
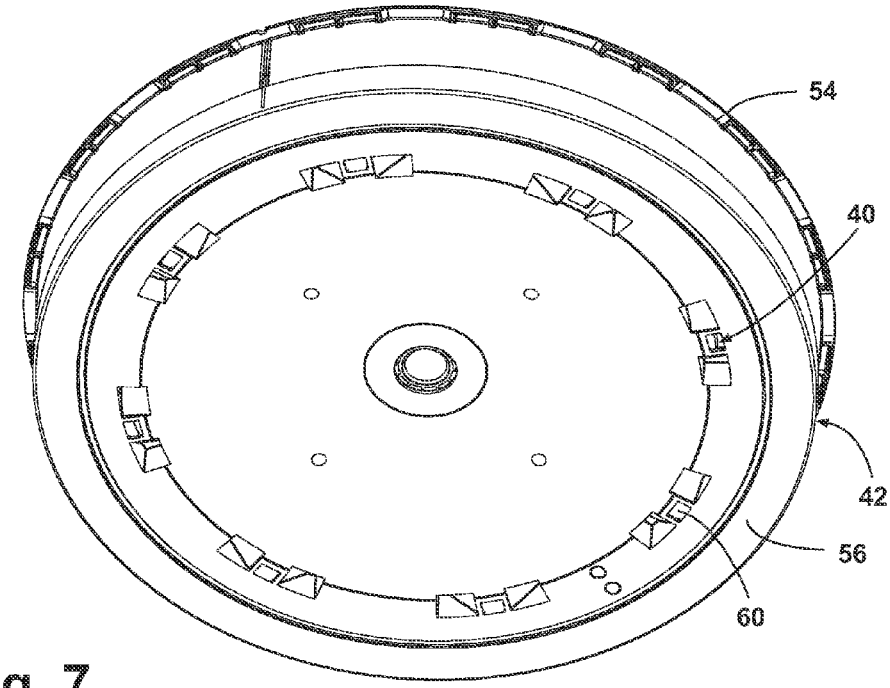
FIG. 7 is a perspective view of the bottom of the base shown in FIG. 3.
Figure 8:
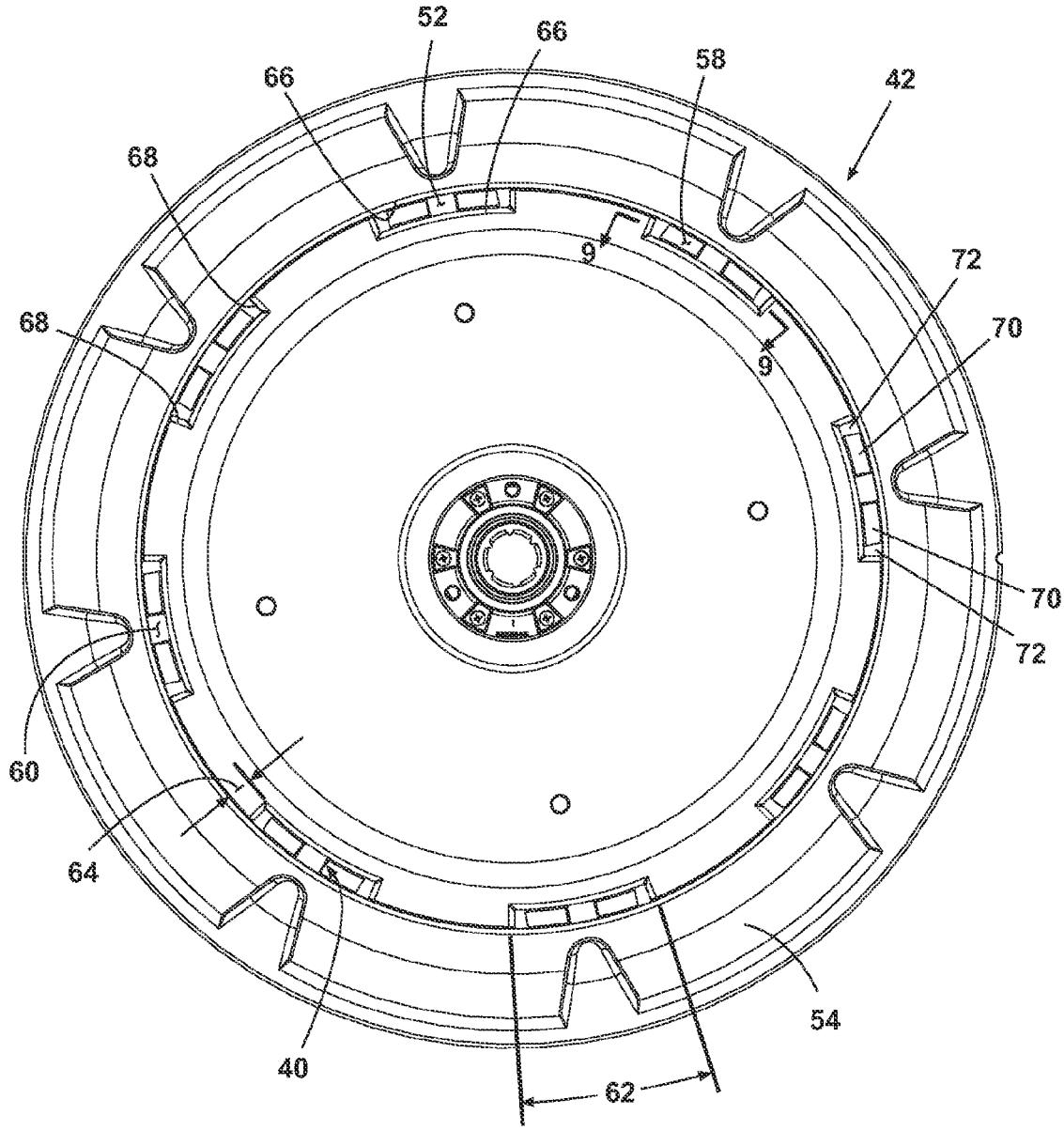
FIG. 8 is a top view of the base shown in FIG. 3.

Each foreign object passageway 52 defines an inlet opening 58 (FIG. 6) facing the agitator 20 and an outlet opening 60 (FIG. 7) facing the tub 14. The inlet opening 58 has an elongated opening having an opening length 62 and an opening width 64 commensurate with an opening length-to-width ratio of 7:1 (FIG. 8). The inlet opening 58 has been illustrated as having an arc shape and the opening length 62 is taken at the longest portion of the curve. Further, other shapes have been contemplated for the inlet opening 58. An exemplary measurement of the opening length 62 is 70 mm and an exemplary measurement of the opening width 64 is 10 mm.

Figure 9:
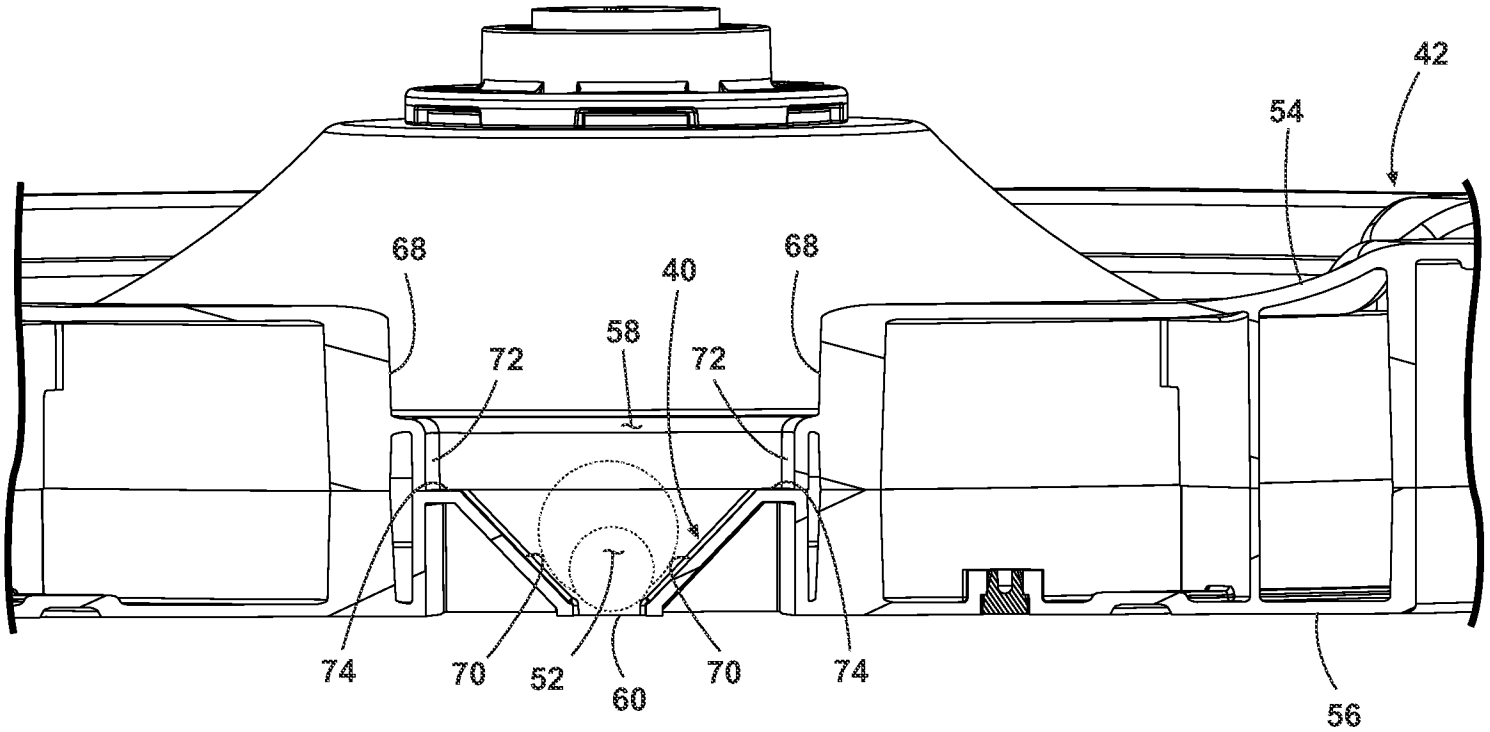
FIG. 9 is a cross-sectional view taken along the line 9-9 of a portion of the base shown in FIG. 8.

Referring to FIG. 9, the outlet opening 60 has a smaller length than its inlet counterpart has and consequently has an area less than the inlet opening 58. The opening length 62 and opening width 64 of the inlet opening 58 may thus be sized such that a circular coin having at least a 17.0 mm diameter and at least a 1.3 mm thickness may be received on edge within the inlet opening. Further, the opening length 62 and opening width 64 of the inlet opening 58 may thus be sized such that a circular coin having at least a 24.0 mm diameter and at least a 1.7 mm thickness may be received on edge within the inlet opening. This would mean that the foreign object trap 40 may accommodate multiple coins including United States quarter and dime coins in addition to other United States coins and foreign coins.

Opposing sidewalls 66 are connected by opposing end walls 68, which define the foreign object passageway 52. As illustrated in FIG. 9, the end walls 68 have a tapered portion 70, which tapers inwardly in a direction from the inlet opening 58 to the outlet opening 60. The end walls 68 also have a vertical portion 72 between the inlet opening 58 and the tapered portion 70 and a horizontal portion 74 between the vertical portion 72 and the tapered portion 70. Exemplary dimensions of the foreign object trap 40 include a vertical portion 72 having a length of 14.3 mm, a horizontal portion 74 having a length of 6 mm, and a tapered portion 70 having a length of 31.4 mm. Further, the vertical portion 72 is illustrated as being set below the inlet opening 58 approximately 23 mm and this provides additional clearance between the tapered portion 70 and the agitator 20. Thus, the foreign object passageway 52 may be shaped to receive on edge a circular coin having a diameter of at least 24 mm without any portion of the coin contacting any portion of the agitator 20. In FIG. 9, two coins having differing diameters are shown in phantom. The diameters of the coins illustrated are not specific to any particular coin and are for illustrative purposes only.

The end walls 68 and side walls 66 are arranged such that any coin in the wash water flow, and of a diameter within a predetermined range, will become lodged within the foreign object passageway 52 in a manner where the coin is on end. That is the coin will remain in a plane that extends substantially in the direction of fluid flow in the foreign object passageway 52, so that the coin will not obstruct the foreign object passageway 52. Thus, even though one or several coins may be located in a single foreign object passageway 52 wash water may still flow through the foreign object passageway 52 to the region below the wash basket 18.

The plurality of foreign object passageways 52 are configured to provide a collective volumetric flow rate greater than the predetermined volumetric flow rate of the pump 34. For example, in one embodiment, the volumetric flow rate of the pump 34 may be 21 liters per minute. More specifically, as the outlet opening of the foreign object passageway 52 has an area less than the inlet opening, the foreign object passageways 52 are configured to provide a collective outlet volumetric flow rate greater than the predetermined volumetric flow rate of the pump 34. The foreign object trap 40 may be designed such that even if one or more than one of the foreign object passageways 52 has a foreign object received within it, the volumetric flow rate of the remaining subset of the plurality of foreign object passageways 52, more specifically the outlet volumetric flow rate, is greater than the volumetric flow rate of the pump 34. This ensures that the flow rate to the pump 34 is sufficient for proper operation of the pump 34.

The washing machine operates in the following manner. During a recirculation or drain portion of the cycle wash water flows beneath the agitator 20 and into the base 42. Wash water then flows into foreign object trap 40 through the inlet opening 58 and through the multiple foreign object passageways 52. Any foreign objects of a predetermine diameter carried by the flow of wash water will enter the foreign object passageway 52 and be collected within the foreign object passageway 52. Wash water and foreign objects below a predetermine diameter exit the foreign object passageway 52 via the outlet opening 60. The wash water then passes through the sump 16 and pump 34 and along the appropriate conduit to either be recirculated or drained as the case may be.

As is apparent from the foregoing specification, the invention is susceptible of being embodied with various alterations and modifications, which may differ particularly from those that, have been described in the preceding specification and description. It should be understood that we wish to embody within the scope of the patent warranted hereon all such modifications as reasonably and properly come within the scope of our contribution to the art.

What is claimed is:

1. A washing machine comprising:

a tub defining an interior;

a sump in fluid communication with the interior of the tub;

a wash basket located within the interior and defining a laundry treating space;

a clothes mover located within the laundry treating space and overlying at least a portion of the wash basket; and a foreign object trap located in a portion of the wash basket and having opposing sidewalls connected by opposing end walls and defining a foreign object passageway defining an inlet opening and an outlet opening, with the outlet opening having an area less than the inlet opening and wherein the end walls have a tapered portion, which tapers inwardly in a direction from the inlet opening to the outlet opening.

2. The washing machine according to claim 1 wherein the end walls further comprise a vertical portion between the inlet opening and the tapered portion.

3. The washing machine according to claim 2 wherein the end walls further comprise a horizontal portion between the vertical portion and the tapered portion.

4. The washing machine according to claim 1 wherein the foreign object passageway is located in the basket at a location under the clothes mover.

5. The washing machine according to claim 1 wherein the foreign object trap comprises a plurality of foreign object passageways.

6. The washing machine according to claim 5, further comprising a pump having an inlet fluidly coupled to the sump and an outlet configured to fluidly couple to a household drain, wherein the plurality of foreign object passageways are configured to provide a collective volumetric flow rate greater than the volumetric flow rate of the pump.

7. The washing machine according to claim 6 wherein the volumetric flow rate of a subset of the plurality of foreign object passageways is greater than the volumetric flow rate of the pump.

8. The washing machine according to claim 1 wherein the clothes mover defines a body rotatable about an axis of rotation, the body has a peripheral skirt, and the foreign object passageway located in the wash basket radially inwardly of the peripheral skirt.

9. The washing machine of claim 1 wherein the inlet opening is an elongated opening having a length and width commensurate with a length-to-width ratio of 7:1.

10. The washing machine according to claim 9 wherein the length and width of the inlet opening are sized such that a circular coin having at least a 17.0 mm diameter and at least a 1.3 mm thickness may be received within the inlet opening.

11. The washing machine according to claim 10 wherein the length and width of the inlet opening are sized such that a coin having at least a 24.0 mm diameter and at least a 1.7 mm thickness may be received within the inlet opening.

12. A washing machine comprising:

a tub defining an interior;

a sump in fluid communication with the interior of the tub;

a wash basket located within the interior of the tub and defining a laundry treating space;

a clothes mover located within the laundry treating space and overlying at least a portion of the wash basket; and at least one foreign object trap located in a portion of the wash basket beneath the clothes mover, the at least one foreign object trap having at least one passageway having an inlet facing the clothes mover and an outlet facing the tub, wherein the passageway is shaped to receive on edge a circular coin having a diameter of at least 24 mm without any portion of the coin contacting any portion of the clothes mover and where opposing sidewalls connected by opposing end walls define the passageway, with the end walls having a tapered portion, which tapers inwardly in a direction from the inlet to the outlet.

13. The washing machine according to claim 12 wherein the end walls further comprise a vertical portion between the inlet and the tapered portion.

14. The washing machine according to claim 13 wherein the end walls further comprise a horizontal portion between the vertical portion and the tapered portion.

* * * * *